US005401389A

United States Patent [19]

Mazzone et al.

[11] Patent Number: 5,401,389

[45] Date of Patent: Mar. 28, 1995

[54] GASOLINE-CYCLE OIL UPGRADING PROCESS

[75] Inventors: Dominick N. Mazzone, Wenonah; Samual A. Tabak, Moorestown; Hye Kyung C. Timken, Woodbury, all of N.J.

[73] Assignee: Mobil Oil Corporation, Fairfax, Va.

[21] Appl. No.: 133,942

[22] Filed: Oct. 12, 1993

Related U.S. Application Data

[63] Continuation-in-part of Ser. No. 891,124, Jun. 1, 1992, which is a continuation-in-part of Ser. No. 850,106, Mar. 12, 1992, which is a continuation-in-part of Ser. No. 745,311, Aug. 15, 1991, Pat. No. 5,346,609.

[51] Int. Cl.[6] ..... C10G 69/00; C10G 69/02

[52] U.S. Cl. ..... 208/89; 208/212

[58] Field of Search ..... 208/89, 212

[56] References Cited

U.S. PATENT DOCUMENTS

| | | | |
|---|---|---|---|
| 3,759,821 | 9/1973 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/211 |
| 4,049,542 | 9/1977 | Gibson et al. | 208/213 |
| 4,062,762 | 12/1977 | Howard et al. | 208/211 |
| 4,419,220 | 12/1983 | La Pierre | 208/111 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/212 |
| 4,911,823 | 3/1990 | Chen et al. | 208/67 |
| 4,997,543 | 3/1991 | Harandi et al. | 208/49 |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

Light cycle oil (LCO) is upgraded to a low sulfur gasoline by co-processing the LCO with a cracked, sulfur-containing olefinic naphthas by hydrodesulfurization followed by treatment over an acidic catalyst comprising zeolite beta with a metal hydrogenation component such as molybdenum. The treatment over the acidic catalyst in the second step restores the octane loss which takes place as a result of the hydrogenative treatment and results in a low sulfur gasoline product with an octane number comparable to that of the feed naphtha. The zeolite beta catalyst is active for conversion of the higher boiling portions of the feed to products of low sulfur content in the gasoline boiling range.

20 Claims, No Drawings

GASOLINE-CYCLE OIL UPGRADING PROCESS

CROSS REFERENCE TO RELATED APPLICATIONS

This application is a continuation-in-part of prior application Ser. No. 07/891,124, filed Jun. 1, 1992 pending which, in turn, is a continuation-in-part of prior application Ser. No. 07/850,106, filed Mar. 12, 1992, pending, which, in turn, is a continuation-in-part of prior application Ser. No. 07/745,311, filed Aug. 15, 1991, now U.S. Pat. No. 0,346,609 issued Sep. 13, 1994. This application is also a continuation-in-part of Ser. Nos. 07/850,106 and 07/745,311, now U.S. Pat. No. 5,346,609. This application is also related to co-pending application Ser. No. 08/133,403, filed Oct. 8, 1993.

FIELD OF THE INVENTION

This invention relates to a process for the upgrading of hydrocarbon streams. It more particularly refers to a process for upgrading gasoline boiling range petroleum fractions containing substantial proportions of sulfur impurities. Another advantage of the present process is that it enables the end point of catalytically cracked gasolines to be maintained within the limits which are expected for Reformulated Gasoline (RFG) under the EPA Complex Model.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons. In addition other environmental controls may be expected to impose increasingly stringent limits on gasoline composition. Currently, the requirements of the U.S. Clean Air Act and the physical and compositional limitations imposed by the Reformulated Gasoline (RFG) and EPA Complex Model regulations will result not only in a decrease in permissible sulfur levels but also in limitations on boiling range, typically measured by minimum Reid Vapor Presssure (RVP) and $T_{90}$ specifications. Limitations on aromatic content may also arise from the Complex Model regulations.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reform ate may be increased further by processes such as those described in U.S. Pat. Nos. 3,767,568 and 3,729,409 (Chen) in which the reform ate octane is increased by treatment of the reform ate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending applications Ser. Nos. 07/850, 106, filed Mar. 12, 1992, Ser. No. 07/745,311, filed Aug. 15, 1991, we have described processes for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/735,311 and 07/850,106 for a detailed description of these processes.

As shown in these prior applications, zeolite ZSM-5 is effective for restoring the octane loss which takes place when the initial naphtha feed is hydrotreated. When the hydrotreated naphtha is passed over the catalyst in the second step of the process, some components of the gasoline are cracked into lower boiling range materials, if these boil below the gasoline boiling range, there will be a loss in the yield of the gasoline product. If, however, the cracking products are within the gasoline range, a net volumetric yield increase occurs. To achieve this, it is helpful to increase the end point of the naphtha feed to the extent that this will not result in the gasoline product end point or similar restrictions (e.g. $T_{90}$, $T_{95}$) being exceeded. While the intermediate pore size zeolites such as ZSM-5 will convert the higher boiling components of the feed, a preferred mode of operation would be to increase conversion of the higher boiling components to products which will remain in the gasoline boiling range.

In co-pending application Ser. No. 08/133,403, we demonstrated the advantages of using a metal-containing zeolite beta catalyst in the second step of the process. Zeolite beta is relatively more effective than ZSM-5 for the conversion of the higher boiling components of the naphtha; more of the heavier, back-end portion of the feed is converted to lighter gasoline components. Compared to a ZSM-5 based catalyst, the conversion of all fractions boiling above 300° F. (about 150° C.) is significantly greater. This has potential benefit in situations where reduced gasoline end-point is required. The presence of a hydrogenation component on the zeolite beta catalyst, preferably a mild hydrogenation component such as molybdenum, has also been found to be effective for optimizing gasoline octane and yield and for catalyst activity, stability and selectivity. Other advantages for zeolite beta were also shown: compared to ZSM-5, the zeolite beta catalyst gives a final gasoline product with a lower total sulfur level, compared either to the feed or to the intermediate product from the hydrodesulfurization step. The zeolite beta catalysts are also very effective in reducing mercaptan sulfur as well as the heavier sulfur components.

SUMMARY OF THE INVENTION

We have now found that catalysts based on zeolite beta are effective for co-processing light cycle oil with the naphtha. Based on this discovery, we have developed a cycle oil upgrading process in which a minor amount of light cycle oil is co-processed with the naphtha to produce a low sulfur, high octane gasoline. The zeolite beta catalyst is effective in its conversion of the higher boiling components of the feed and converts some of the cycle oil to products within the gasoline boiling range so that the final gasoline yield is increased.

According to the present invention, therefore, a process for catalytically desulfurizing cracked petroleum fractions in the gasoline boiling range to reduce sulfur to acceptable levels and for co-processing a light cycle oil fraction to improve the gasoline yield, uses an initial hydrotreating step to desulfurize the feed with some reduction in octane number, after which the desulfurized material is treated with a zeolite beta catalyst to restore lost octane to the gasoline fraction and to promote the conversion of the higher boiling fractions of the mixed feed to components boiling in the gasoline boiling range. In favorable cases, the volumetric yield of gasoline boiling range product is comparable to the volume of the feed so that, given a comparable octane level in the feed and the gasoline product, the number of octane barrels of product is at least equivalent to the number of octane barrels of feed. Besides providing incremental gasoline, use of the process will provide additional flexibility in upgrading LCO. It also provides the potential for improving the quality of the diesel fuel pool since removal of even a small amount of the light portion of the cycle oil, which has the lowest cetane number, from the diesel fuel pool should improve the ignition quality of the diesel fuel.

The process may be utilized to desulfurize catalytically and thermally cracked naphthas including light as well as full range naphtha fractions, while maintaining octane so as to obviate the need for reforming such fractions, or at least, without the necessity of reforming such fractions to the degree previously considered necessary. Since reforming generally implies a significant yield loss, this constitutes a marked advantage of the present process.

Detailed Description

Feed

Cracked Naphtha

The feed to the process is a mixed feed which comprises a naphtha and a minor amount of a light cycle oil. The naphtha is an olefinic, sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points ($T_{95}$) of at least 380° F. (about 193° C.) or at least about 400° F. (about 220° C.). The process may be applied to thermally cracked and catalytically cracked naphthas since both are usually characterized by the presence of olefinic unsaturation and the presence of sulfur. From the point of view of volume, however, the main application of the process is likely to be with catalytically cracked naphthas, especially FCC naphthas and for this reason, the process will be described with particular reference to the use of catalytically cracked naphthas.

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Light Cycle Oil

In addition to the naphtha component, the feed contains a minor amount, typically up to about 20 weight percent, but usually not more than about 10 weight percent, of a light cycle oil component.

Light cycle oil (LCO) is a highly aromatic, hydrogen-deficient middle distillate having high levels of sulfur and nitrogen. Light cycle oils are produced by the catalytic cracking of petroleum feeds such as gas oils and resids and are ususally taken off from the catalytic cracking process as a fraction above the cracked gasoline fraction. Although full range cycle oils may have end points as high as 850° F. (455° C.) or even higher, light cycle oils will typically have an end point no higher than about 800° F. (about 425° C.); in most cases the end point will be in the range of about 600° to about 700° or 750° F. (about 315° to about 370° or 400° C.). The aromatic content of most light cycle oils is usually above about 50 percent (by silica gel separation) and in most cases is from about 80 to about 90 weight percent, with highly substituted naphthalenes making up a the largest single portion of the total aromatics; typically, the naphthalenes will be in the range of about 30 to 60 weight percent of the total aromatics, in most cases from about 35 to about 50 weight percent of total aromatics. Consistent with the aromatic character of the light cycle oils, the API gravity will be low, usually in the range of 10 to 20, although values as low as about 8 may be encountered in some instances and higher values in the range of 20 to 30 are obtained when the catalytic cracking unit is run under conditions to favor distillate production. An API gravity of about 15 is typical for many light cycle oils. Hydrogen content is concomitant with the API gravity and the aromatic content, usually from about 6 to 12 weight percent, with values from about 8 to about 10 being typical. Sulfur content will depend on the type of catalytic cracking feed in use but is often from about 1 to 5 weight percent with values from about 2 to 4 being typical, mainly as benzothiophenes and dibenzothiophenes; very little sulfur is present as mercaptans which are mostly found below the LCO boiling range. Total nitrogen is normally in the range of 100 to 1000 ppmw, with many cycle oils having values in the range of about 150 to 650 ppmw; basic nitrogen is rather less, normally from about 20 to 100 ppmw, typically from 30 to 60 ppmw.

In the past there have been difficulties in employing LCO in diesel fuel oils. Diesel fuel must meet a minimum cetane number specification of about 45 in order to operate properly in typical automotive diesel engines. Because cetane number correlates closely and inversely with aromatic content, the highly aromatic cycle oils from the cracker typically with aromatic contents of 80% or even higher have cetane numbers as low as 4 or 5. In order to raise the cetane number of these cycle stocks to a satisfactory level by the conventional CHD technology, substantial and uneconomic quantities of hydrogen and high pressure processing would be required. By contrast, the present process permits a portion of the LCO to be upgraded economically and easily to gasoline. In addition, the removal of the lowest boiling fraction of the LCO is likely to result in an improvement in the cetane number of the remaining portion because it is the lightest components of the LCO which have the lowest cetane ratings. The combined feed fractions will typically have a 95 percent point of at least 350° F., an olefin content of 10 to 20 weight percent, a sulfur content from 100 to 25,000 ppmw and a nitrogen content of 5 to 250 ppmw.

Narrower cuts within the light cycle oil range may be used in the present process, for example, a light cut LCO, for example, an LCO fraction having a boiling range from about 600° to about 700° F. LCO fractions such as this may be obtained by fractionation of a full range cycle oil (FRCO) or by adjustment of the cut points on the cracker fractionation column. The light cut fractions will, nevertheless, retain the highly aromatic character of the catalytic cracking cycle oils (e.g. greater than 60% aromatics) but because the lighter fractions used will generally exclude the heavier polynuclear aromatics (PNAs-three rings or more) which remain in the higher boiling range fractions, they will be more desirable for co-processing in the present process where gasoline is the primary product. In addition, the concentration of the heteroatom contaminants, particularly the refractory contaminants such as the dibenzothiophenes which are difficult to remove by conventional hydroprocessing at low severities, in the higher boiling fractions provides an additional incentive to use the lighter LCO fractions in the present process.

Process Configuration

The sulfur-containing, naphtha/LCO feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

The hydrotreated intermediate product which usually has a boiling range which is not substantially higher than the boiling range of the feed, is then treated by contact with the zeolite beta catalyst under conditions which produce a second product comprising a fraction which boils in the gasoline boiling range which has a higher octane number than the portion of the hydrotreated intermediate product fed to this second step. The product from this second step is of lower sulfur content while having a comparable octane rating as the result of the second stage treatment.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5+$) materials may occur.

Octane Restoration—Second Step Processing

After the hydrotreating step, the hydrotreated intermediate product is passed to the second step of the process in which cracking takes place in the presence of the acidic catalyst containing zeolite beta. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The separation of the light ends at this point may be desirable if the added complication is acceptable since the saturated $C_4$–$C_6$ fraction from the hydrotreater is a highly suitable feed to be sent to the isomerizer for conversion to iso-paraffinic materials of high octane rating; this will avoid the conversion of this fraction to nongasoline ($C_5-$) products in the second stage of the process. Another process configuration with potential advantages is to take a heart cut, for example, a 195°–302° F. (90°–150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst. The hydrotreatment in the first stage is effective to desulfurize and denitrogenate the catalytically cracked naphtha which permits the heart cut to be processed in the reformer. Thus, the preferred configuration in this alternative is for the second stage to process the $C_8+$ portion of the first stage effluent and with feeds which contain significant amounts of heavy components up to about $C_{13}$ e.g. with $C_9$ –$C_3$ fractions going to the second stage, improvements in both octane and yield can be expected.

The conditions used in the second step of the process are selected to favor a number of reactions which restore the octane rating of the original, cracked feed at least to a partial degree. The reactions which take place during the second step which converts low octane paraffins to form higher octane products, both by the selective cracking of heavy paraffins to lighter paraffins and the cracking of low octane n-paraffins, in both cases with the generation of olefins. Ring-opening reactions may also take place, leading to the production of further quantities of high octane gasoline boiling range components; zeolite beta is particularly effective for the production of branched-chain $C_4$ and $C_5$ materials, possibly by the ring-opening reactions. Isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating×volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° to 430° C.), although the conditions used with the LCO co-feed may need to be a little more severe than those used with a naphtha feed. As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 3000 SCF/Bbl (about 18 to 534 $n.l.l^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5-$) during the second stage is held to a minimum. However, because the cracking of the heavier portions of the feed may lead to the production of products still within the gasoline range, no net conversion to $C_5-$ products may take place and, in fact, a net increase in $C_5+$ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point ($T_{95}$) will not exceed about 520° F. (about 270° C.) and usually will be not more than about 500° F. (about 260° C.).

The active component of the catalyst used in the second step is zeolite beta. The aluminosilicate forms of this zeolite have been found to provide the requisite degree of acidic functionality and for this reason are the preferred forms of the zeolite. The aluminosilicate form of zeolite beta is described in U.S. Pat. No. 3,308,069 (Wadlinger). Other isostructural forms of the zeolite containing other metals instead of aluminum such as gallium, boron or iron may also be used.

The zeolite beta catalyst possesses sufficient acidic functionality to bring about the desired reactions to restore the octane lost in the hydrotreating step. The catalyst should have sufficient acid activity to have cracking activity with respect to the second stage feed (the intermediate fraction), that is sufficient to convert the appropriate portion of this material as feed. One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis*, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis*, 61,395 (1980).

The zeolite beta catalyst suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The zeolite component of the catalyst will usually be composited with a binder or substrate because the particle sizes of the pure zeolite are too small and lead to an excessive pressure drop in a catalyst bed. This binder or substrate, which is preferably used in this service, is suitably any refractory binder material. Examples of these materials are well known and typically include silica, silica-alumina, silicazirconia, silica-titania, alumina.

The zeolite beta catalyst contains a metal hydrogenation function for improving catalyst activity and selectivity. In addition, the metal hydrogenation components may also favorably affect the operation of the process, especially with respect to catalyst activity, selectivity and stability. The aging characteristics of the zeolite beta catalysts are, in particular, favorably affected by the inclusion of the mild hydrogenation component. Suitable hydrogenation components on the catalyst are metals having hydrogenation-dehydrogenation activity, including metals such as the Group VI and VIII base metals or noble metals or combinations of such metals. Noble metals which may be used include platinum and palladium but these may offer no significant advantage over base metals such as nickel, cobalt, molybdenum or chromium and will normally not be preferred, particularly when, as with platinum, sensitivity to sulfur poisoning may arise with the hydrotreated sulfur-containing feeds. Combinations of metals may also be used, for example, a combination of a Group VI metal such as chromium, molybdenum or tungsten with a Group VIII metal such as cobalt or nickel. It has been found that the mild hydrogenation activity provided by base metals such as the Group VI metals, molybdenum and tungsten, either alone or in appropriately low concentrations with Group VIII base metals such as nickel or cobalt, e.g. CoMo, NiMo, provide good results. Molybdenum has been found to give good results, particularly when catalyst stability is concerned since molybdenum is resistant to sulfur poisoning. More active hydrogenation components such as nickel in appropriate concentrations may, however, also be used. If a base metal hydrogenation component is used, a metal content of about 0.5 to about 5 weight percent is suitable although higher metal loadings typically up to about 10 weight percent may be used. If a more active noble metal such as platinum is used, a metal content of about 0.1 to about 2 weight percent would be typical and appropriate. Even though the effluent from the hydrotreater contains inorganic sulfur and nitrogen, the use of the more active zeolite catalyst in the second step permits noble metals to be present on the catalyst.

The metal component may be incorporated into the catalyst by conventional procedures such as cation exchange, impregnation into an extrudate or by mulling with the zeolite and the binder. When the metal is added in the form of an anionic complex such as molybdate or vanadate, impregnation or addition to the muller will be an appropriate method.

The particle size and the nature of the zeolite beta catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the fixed-bed type of operation preferred.

The conditions of operation and the catalysts should be selected, together with appropriate feed characteristics to result in a product slate in which the gasoline product octane is not substantially lower than the octane of the feed gasoline boiling range material; that is, not lower by more than about 1 to 3 octane numbers. It is preferred also that the volume of the product should not be substantially less than that of the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The ability of the zeolite beta catalysts to convert the higher boiling components of the feed enables a portion of the LCO feed material to be brought into the normal gasoline boiling range and thereby improves the gasoline yield of the process. The main mechanisms for LCO upgrading using the metal-containing zeolite beta catalysts are believed to be desulfurization and back-end conversion. The metal-containing zeolite beta catalysts appear to achieve desulfurization by suppression of mercaptan formation and cracking of heavy end sulfur species. It is also conceived that the metal function on the catalyst may promote saturation of olefins and, in so doing, hinder mercaptan recombination reactions. The improved back end conversion obtained with zeolite beta results in a boiling range shift towards the desired gasoline product from the relatively heavier feed used in the present operation. In addition, the metal function may stabilize the catalyst by converting cracked intermediates to iso-paraffins and eliminating coke precursors.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

In the following examples, parts and percentages are by weight unless they are expressly stated to be on some other basis. Temperatures are in °F. and pressures in psig, unless expressly stated to be on some other basis.

Example 1

Preparation of a Mo/zeolite beta catalyst

A physical mixture of 65 parts zeolite beta and 35 parts pseudoboehmite alumina powder (LaRoche Versal TM alumina) as mulled to form a uniform mixture and formed into 1/16 inch (1.5 mm) cylindrical shape extrudates using a standard augur extruder. All components were blended based on parts by weight on a 100% solids basis. The extrudates were dried on a belt drier at 127° C., and were then nitrogen calcined at 480° C. for 3 hours followed by a 6 hour air calcination at 538° C. Then the catalyst was steamed at 100% steam at 480° C. for 4 hours. The steamed extrudates were impregnated with 4 wt % Mo and 2 wt % P using an incipient wetness method with ammonium heptamolybdate and phosphoric acid solution. The impregnated extrudates were then dried at 120° C. overnight and calcined at 500° C. for 3 hours. The properties of the final catalyst are listed in Table 1 below which also gives the properties of the HDS catalyst used in the performance comparisons.

TABLE 1

| Physical Properties of Catalysts | HDS Cat | Stmd. Mo/Beta |
|---|---|---|
| Zeolite | — | Beta |
| Zeolite, wt % | — | 65 |
| Alpha | — | 141* |
| Surface area, $m^2/g$ | 260 | 415 |
| cy-Hexane sorption, cc/g | — | 14.9 |
| Co, wt % | 3.4 | NA |
| Mo, wt % | 10.2 | 3.8 |

*: Before the metal loading.
NA: Not applicable.

Example 2

Performance Evaluation—Heavy FCC Naphtha/LCO Blend

This Example illustrates the LCO upgrading capability of the catalyst of Example 1. The catalyst converts the boiling range of the LCO towards the gasoline range. In addition, the catalyst has advantages over HDS alone in producing low sulfur, high octane gasoline.

In this Example, a blend of heavy naphtha and LCO prepared with 90 vol. percent heavy FCC naphtha and 10 vol. percent full range LCO was used to demonstrate the process. In a refinery this could be implemented by shifting the cut point of the FCC naphtha distillation column so that the additional LCO components are drawn for the gasoline upgrading. The feedstock properties are shown in Table 2 below.

TABLE 2

| Properties | FEED PROPERTIES Sour Heavy Naphtha | Full LCO | 90 vol %/ 10 vol % Heavy naphtha/LCO |
|---|---|---|---|
| Nominal Boiling Range, °F. | 350–490 | 600–750 | 350–520 |
| Specific Gravity, g/cc | 0.916 | — | 0.922 |
| Total Sulfur, wt % | 1.9 | — | 2.0 |
| Nitrogen, ppm | 180 | 400 | 230 |
| Bromine Number | 10.4 | 2.3 | 15.0 |
| Research Octane | 96.4 | — | 95.5 |
| Motor Octane | 84.0 | — | 83.7 |
| Distillation, °F. (D86) | | | |
| IBP | 194 | 580 | 198 |
| 5% | 382 | 628 | 377 |
| 10% | 394 | 639 | 395 |
| 30% | 419 | 667 | 423 |
| 50% | 435 | 690 | 441 |
| 70% | 451 | 711 | 460 |
| 90% | 476 | 739 | 499 |
| 95% | 488 | 748 | 534 |
| EP | 511 | 749 | 615 |

The experiments were carried out in a fixed-bed pilot unit employing a commercial $CoMo/Al_2O_3$ hydrodesulfurization (HDS) catalyst in an upper reaction zone and the zeolite catalyst in a lower zone. Typically 30–60 cc of each catalyst was sized to 14/28 mesh and loaded in a reactor. The pilot unit was operated in a cascade mode where desulfurized effluent from the hydrotreating stage cascaded directly to the zeolite-containing catalyst to restore octane without removal of ammonia, hydrogen sulfide, and light hydrocarbon gases at the interstage. The HDS/zeolite catalyst system was presulfided with a 2%$H_2S$/98%$H_2$ gas mixture prior to the evaluations. The conditions employed for the experiments included temperatures from 500°–800° F. (260°–427° C.), 1.0 LHSV (based on fresh feed relative to total catalysts), 3000 scf/bbl (534 $n.l.l^{-1}$) of once-through hydrogen circulation, and hydrogen inlet pressure of 600 psia (4140 kPaa). The ratio of HDT to the cracking catalyst was typically 1/1, vol/vol.

The results of the comparison are given below in Table 3, together with the results of a base-case comparison run using the heavy naphtha feed with a ZSM-5 catalyst(65% ZSM-5, 35% alumina, alpha=101 prepared by mulling 65 parts ZSM-5 and 35 parts pseudoboehmite alumina powder (LaRoche Versal TM alumina) to form a mixture which was extruded to 1/16 inch (1.5 mm) cylindrical extrudates which were dried on a belt drier at 127° C. The extrudates were then nitrogen calcined at 480° C. for 3 hours followed by a 6 hour air calcination at 538° C. and steamed with 100% steam at 480° C. for approximately 4 hours).

TABLE 3

Convention of 90/10 Heavy FCC Naphtha/LCO to Gasoline

| | Nphtha/ LCO Blend Feed | Nphtha only HDS/ HZSM-5 | Nphtha/ LCO HDS only | Naphtha/LCO Blend HDS/Mo-Beta | |
|---|---|---|---|---|---|
| Stage 1 Temp., °F. | — | 725 | 726 | 698 | 700 |
| Stage 2 Temp., °F. | — | 762 | Nil | 778 | 802 |
| Total Sulfur, wt % | 2.0 | 0.03* | 0.01* | 0.01* | 0.01* |
| Nitrogen, ppm | 230 | 1* | 29* | 30* | 30* |
| S.G., g/cc | 0.922 | 0.879 | 0.890 | 0.886 | 0.884 |
| Research Octane | 95.5 | 98.4 | 92.4 | 96.1 | 97.3 |
| Motor Octane | 83.7 | 85.4 | 80.9 | 83.7 | 85.2 |
| $C_5$+ Yield, vol % | — | 97.9 | 102.1 | 99.8 | 99.1 |
| Compn., wt % | | | | | |
| $C_5$-390° F. | 15.0 | 35.3 | 26.7 | 30.5 | 34.1 |
| 390–420° F. | 18.1 | 18.8 | 14.6 | 19.4 | 18.6 |
| 420° F.+ | 66.9 | 40.4 | 57.3 | 45.9 | 42.5 |
| Net gaso. yld. gain, wt % | | Base | −15.5 | 2.1 | 7.9 |
| 420° F. + Conversion, wt % | — | 34 | 14 | 31 | 37 |
| $H_2$ Consumption, scf/bbl | — | 730 | 540 | 660 | 620 |

*Sulfur and nitrogen contents were measured for a $H_2S$ stripped product.

The results in Table 3 show that the sulfur level of the finished gasoline after the two-step treatment is comparable to that after the HDT step alone, demonstrating that the zeolite catalyst tends to suppress olefin recombination to mercaptans. The two-step process is also effective in recovering the octane lost in the hydrotreatment. The zeolite beta catalyst used in the second step is active for back-end conversion, as shown by the shift in the boiling points of the feed blend towards the gasoline range. for example, at 800° F., the Mo/beta catalyst produces high octane products with 97.3 octane. The overall gasoline ($C_5$−420° F.) yield can be increased by 2 to 8 wt. percent by utilizing the additional LCO feed in combination with the Mo/beta catalyst. In this example, a full range LCO was used to demonstrate the operation of the process but if 10 vol percent of the lightest LCO fraction were used instead, the advantage could be even more pronounced as the result of converting the LCO components into products boiling within the gasoline boiling range.

The ability of the zeolite beta catalysts to convert the higher boiling components of the feed enables a portion of the LCO feed material to be brought into the normal gasoline boiling range and thereby improves the gasoline yield of the process. The main mechaisms for LCO upgrading using the metal-containing zeolite beta catalysts are believed to be desulfurization and back-end conversion. The metal-containing zeolite beta catalysts appear to achieve desulfurization by suppression of mercaptan formation and cracking of heavy end sulfur species. It is also conceived that the metal function on the catalyst may promote saturation of olefins and, in so doing, hinder mercaptan recombination reactions. The improved back end conversion obtained with zeolite beta results in a boiling range shift towards the desired gasoline product from the relatively heavier feed used in the present operation. In addition, the metal function may stabalize the catalyst by converting cracked intermediates to paraffins and eliminating coke precursors.

We claim:

1. A process of upgrading a cracked, olefinic sulfur-containing feed fraction boiling in the gasoline boiling range while co-processing a light cycle oil, which method comprises:

contacting a hydrocarbon feed comprising (i) a naphtha component boiling in the gasoline boiling range, which is a cracked, olefinic sulfur-containing feed fraction and (ii) a minor amount of a light cycle oil component having a boiling range within the range of 550° to 800° F., with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting the intermediate product in a second reaction zone with an acidic catalyst comprising zeolite beta, to convert at least a part of the intermediate product to a product comprising a fraction boiling in the gasoline boiling range having a higher octane number than the gasoline boiling range fraction of the intermediate product.

2. The process as claimed in claim 1 in which the naphtha component of the feed comprises a full range catalytically cracked naphtha fraction having a boiling range within the range of $C_5$ to 420° F.

3. The process as claimed in claim 1 in which the naphtha component of the feed comprises a heavy catalytically cracked naphtha fraction having a boiling range within the range of 330° to 500° F.

4. The process as claimed in claim 1 in which the naphtha component of the feed comprises a heavy catalytically cracked naphtha fraction having a boiling range within the range of 330° to 412° F.

5. The process as claimed in claim 1 in which the feed fraction comprises a naphtha fraction having a 95 percent point of at least about 380° F.

6. The process as claimed in claim 5 in which the feed fraction comprises a naphtha fraction having a 95 percent point of at least about 400° F.

7. The process as claimed in claim 1 in which the zeolite beta is in the aluminosilicate form.

8. The process as claimed in claim 1 in which the zeolite beta catalyst includes metal hydrogenation component.

9. The process as claimed in claim 8 in which the metal component comprises molybdenum or tungsten.

10. The process as claimed in claim 9 in which the Group VI metal is molybdenum which is present in an amount from about 2 to 10 weight percent of the catalyst.

11. The process as claimed in claim 1 in which the feed comprises the naphtha component and up to 20 volume percent of the light cycle oil component.

12. The process as claimed in claim 1 in which the hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

13. The process as claimed in claim 1 in which the second stage upgrading is carried out at a temperature of about 300° to 900° F., a pressure of about 50 to 1500 psig, a space velocity of about 0.5 to 10 LHSV, and a hydrogen to hydrocarbon ratio of about 0 to 5000 standard cubic feet of hydrogen per barrel of feed.

14. The process as claimed in claim 13 in which the second stage upgrading is carried out at a temperature of about 350° to 850° F., a pressure of about 300 to 1000 psig, a space velocity of about 1 to 6 LHSV, and a hydrogen to hydrocarbon ratio of about 100 to 3000 standard cubic feet of hydrogen per barrel of feed.

15. A process for simultaneously upgrading (i) a catalytically cracked, olefinic sulfur-containing feed fraction boiling in the gasoline boiling range and (ii) a light cycle oil fraction having a boiling range in the range of 500° to 850° F., which process comprises:

hydrodesulfurizing a hydrocarbon feed of:

(i) a naphtha component boiling in the gasoline boiling range and comprising a cracked, olefinic, sulfur-containing gasoline feed having a sulfur content of at least 50 ppmw, an olefin content of at least 5 percent and a 95 percent point of at least 325° F., and (ii) a cycle oil component comprising from 1 to 20 volume percent, based on the volume of the feed, of a light cycle oil fraction produced by the catalytic cracking of a hydrocarbon feed, the light cycle oil fraction having a boiling range in the range of 500° to 850° F. and an API gravity from 8 to 30 and a hydrogen content from 6 to 12 percent, the hydrodesulfurization being carried out with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting the intermediate product in a second reaction zone with a bifunctional catalyst having acidic and hydrogenation functionality, comprising zeolite beta and a metal hydrogenation component, to convert the intermediate product to a product comprising a fraction boiling in the gasoline boiling range having a higher octane number than the gasoline boiling range fraction of the intermediate product.

16. The process as claimed in claim 15 in which the naphtha component has a 95 percent point of at least 350° F., an olefin content of 10 to 20 weight percent, a sulfur content from 100 to 25,000 ppmw and a nitrogen content of 5 to 250 ppmw.

17. The process as claimed in claim 15 in which the hydrodesulfurization is carried out at a temperature of about 500° to 800° F., a pressure of about 300 to 1000 psig, a space velocity of about 1 to 6 LHSV, and a hydrogen to hydrocarbon ratio of about 1000 to 2500 standard cubic feet of hydrogen per barrel of feed and the second stage upgrading is carried out at a temperature of about 350° to 900° F., a pressure of about 300 to 1000 psig, a space velocity of about 1 to 6 LHSV, and a hydrogen to hydrocarbon ratio of about 100 to 3000 standard cubic feet of hydrogen per barrel of feed.

18. The process as claimed in claim 15 in which the bifunctional catalyst includes a base metal of Group VI of the Periodic Table as the hydrogenation component.

19. The process as claimed in claim 15 in which the hydrogenation component is molybdenum.

20. The process as claimed in claim 19 in which the hydrogenation component is molybdenum which is present in an amount of from 2 to 10 weight percent of the catalyst.

* * * * *